US010465452B2

(12) United States Patent
Parlin

(10) Patent No.: US 10,465,452 B2
(45) Date of Patent: Nov. 5, 2019

(54) WELLBORE OPERATIONS USING A MULTI-TUBE SYSTEM

(71) Applicant: Halliburton Energy Services, Inc., Houston, TX (US)

(72) Inventor: Joseph D. Parlin, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 98 days.

(21) Appl. No.: 15/322,352

(22) PCT Filed: Jul. 31, 2014

(86) PCT No.: PCT/US2014/049199
§ 371 (c)(1),
(2) Date: Dec. 27, 2016

(87) PCT Pub. No.: WO2016/018385
PCT Pub. Date: Feb. 4, 2016

(65) Prior Publication Data

US 2017/0130537 A1 May 11, 2017

(51) Int. Cl.
*E21B 17/18* (2006.01)
*E21B 41/00* (2006.01)
(Continued)

(52) U.S. Cl.
CPC ..... *E21B 17/18* (2013.01); *E21B 41/0035* (2013.01); *E21B 43/04* (2013.01); *E21B 43/045* (2013.01); *E21B 43/267* (2013.01)

(58) Field of Classification Search
CPC ..... E21B 17/18; E21B 43/267; E21B 43/045; E21B 41/0035; E21B 43/04
See application file for complete search history.

(56) References Cited

U.S. PATENT DOCUMENTS 4,834,825 A 5/1989 Adams et al.
5,730,220 A 3/1998 Ganelin
(Continued)

FOREIGN PATENT DOCUMENTS

RU 2107813 C1 3/1998
RU 2012107308 A 10/2013

OTHER PUBLICATIONS

Singapore Search Report dated Oct. 12, 2017; Singapore Patent Application No. 11201609124Q.
(Continued)

*Primary Examiner* — Michael R Wills, III
(74) *Attorney, Agent, or Firm* — McGuireWoods LLP

(57) ABSTRACT

A method of completing or stimulating a portion of a wellbore comprising: introducing a treatment fluid into the wellbore, wherein the treatment fluid comprises a base fluid and an insoluble particulate, wherein the treatment fluid flows through a first tube or set of tubes of a multi-tube system during introduction, wherein the multi-tube system comprises multiple tubular members rigidly attached to each other along the axial lengths of the members, and wherein the attached tubular members complimentarily create a cross-sectional shape of a generally D- or wedge-shaped portion of a circle; possibly creating one or more fractures in a subterranean formation; depositing at least a portion of the particulate within the wellbore; and returning at least a portion of the base fluid to a wellhead of the wellbore, wherein the treatment fluid flows through a second tube or set of tubes of the multi-tube system during return.

13 Claims, 5 Drawing Sheets

(51) Int. Cl.
*E21B 43/267* (2006.01)
*E21B 43/04* (2006.01)

(56) References Cited

U.S. PATENT DOCUMENTS

| | | | | |
|---|---|---|---|---|
| 6,089,320 | A | 7/2000 | LaGrange | |
| 6,439,312 | B1 | 8/2002 | Hess et al. | |
| 6,668,932 | B2 | 12/2003 | Hess et al. | |
| 6,712,418 | B1 | 3/2004 | Lathers | |
| 6,729,410 | B2 | 5/2004 | Steele | |
| 6,907,930 | B2 | 6/2005 | Cavender et al. | |
| 7,497,264 | B2 | 3/2009 | Moody et al. | |
| 8,490,697 | B2 | 7/2013 | Garcia et al. | |
| 2002/0108754 | A1 | 8/2002 | Hess et al. | |
| 2002/0189809 | A1 | 12/2002 | Nguyen et al. | |
| 2003/0085037 | A1 | 5/2003 | Roane et al. | |
| 2003/0159827 | A1 | 8/2003 | Steele | |
| 2005/0115713 | A1* | 6/2005 | Restarick ..... | E21B 41/0042 166/313 |
| 2006/0113078 | A1 | 6/2006 | Nguyen et al. | |
| 2007/0089875 | A1 | 4/2007 | Steele et al. | |
| 2013/0319666 | A1 | 12/2013 | Nygardsvoll et al. | |

OTHER PUBLICATIONS

Russian Office Action dated Feb. 26, 2018; Russian Application No. 2016146109.

International Search Report and Written Opinion dated Apr. 28, 2015; International PCT Application No. PCT/US2014/049199.

* cited by examiner

WELLBORE OPERATIONS USING A MULTI-TUBE SYSTEM

TECHNICAL FIELD

Lateral wellbores can be formed from a primary wellbore or from other lateral wellbores. The location where the lateral wellbore branches off from the other wellbore is called a junction. The junction can be sealed. Gravel packing and fracturing operations can be performed in one or more locations within a wellbore, for example in a primary wellbore or a lateral wellbore.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
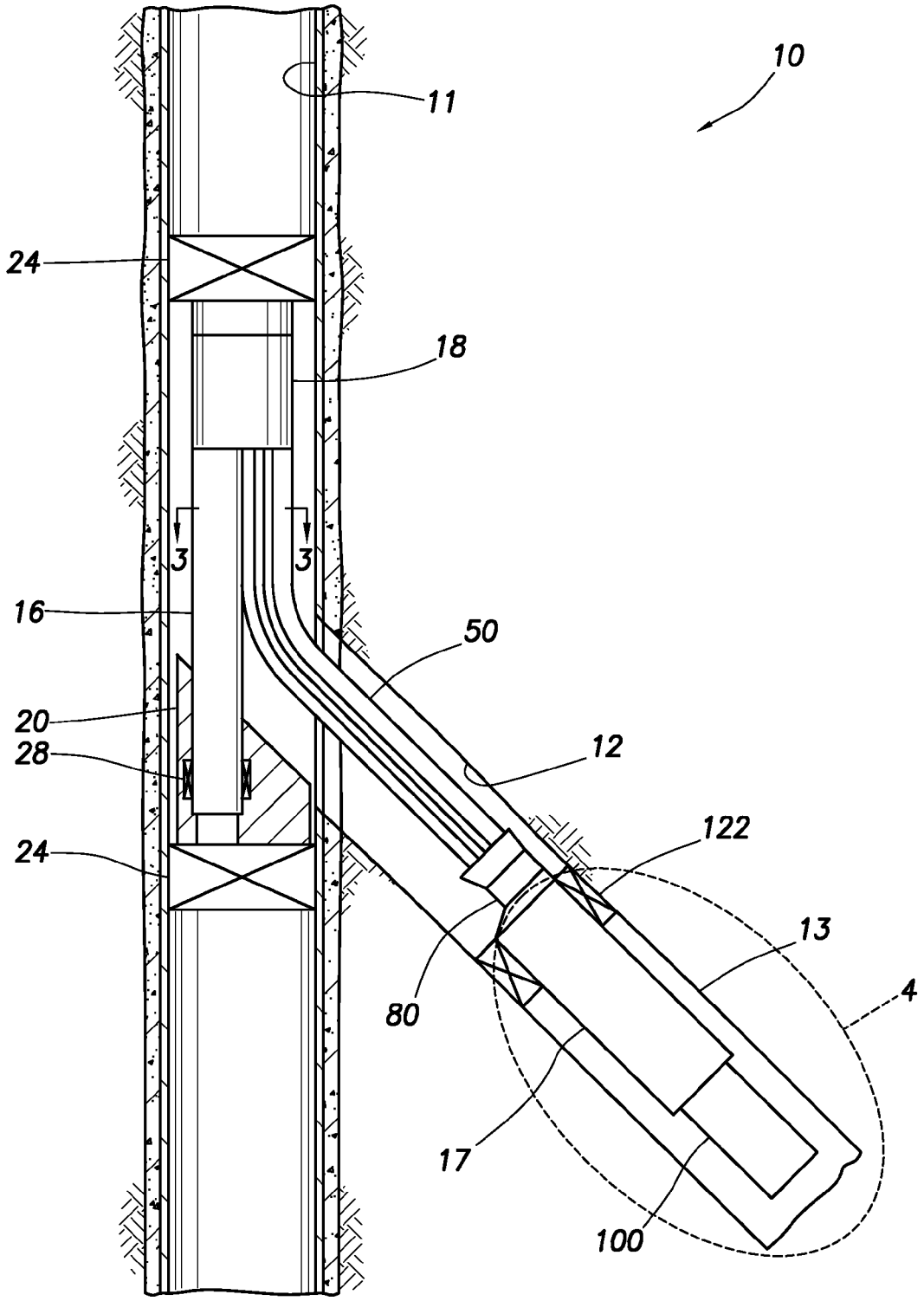
FIG. 1 is a cross-sectional view of a well system including an open hole, lateral wellbore and multi-tube system according to certain embodiments.

As used herein, the words "comprise," "have," "include," and all grammatical variations thereof, are each intended to have an open, non-limiting meaning that does not exclude additional elements or steps.

It should be understood that, as used herein, "first," "second," "third," etc., are arbitrarily assigned and are merely intended to differentiate between two or more packers, tubes, etc., as the case may be, and does not indicate any particular orientation or sequence. Furthermore, it is to be understood that the mere use of the term "first" does not require that there be any "second," and the mere use of the term "second" does not require that there be any "third," etc.

As used herein, a "fluid" is a substance having a continuous phase that tends to flow and conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase, whereas a heterogeneous fluid has more than one distinct phase. A colloid is an example of a heterogeneous fluid. A heterogeneous fluid can be: a slurry, which includes a continuous liquid phase and undissolved solid particles as the dispersed phase; an emulsion, which includes a continuous liquid phase and at least one dispersed phase of immiscible liquid droplets; or a foam, which includes a continuous liquid phase and a gas as the dispersed phase.

As used herein, the words "treatment" and "treating" mean an effort used to resolve a condition of a well. Examples of treatments include, for example, completion, stimulation, isolation, or control of reservoir gas or water. As used herein, a "treatment fluid" is a fluid designed and prepared to resolve a specific condition of a well or subterranean formation, such as for stimulation, isolation, completion, or control of gas or water coning. The term "treatment fluid" refers to the specific composition of the fluid as it is being introduced into a well. The word "treatment" in the term "treatment fluid" does not necessarily imply any particular action by the fluid.

Oil and gas hydrocarbons are naturally occurring in some subterranean formations. In the oil and gas industry, a subterranean formation containing oil or gas is referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from the wellbore is called a reservoir fluid.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered the region within approximately 100 feet radially of the wellbore. As used herein, "into a well" means and includes into any portion of the well, including into the wellbore or into the near-wellbore region via the wellbore. As used herein, "into a subterranean formation" means and includes into any portion of a subterranean formation including, into a well, wellbore, or the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

There are a variety of oil and gas operations that require the placement of large volumes of fluids at high flow rates. Two such examples are gravel packing and hydraulic fracturing.

Gravel packing is often performed in conjunction with the use of a sand control assembly. Sand control techniques are often used in open-hole wellbore portions or soft formations where undesirable migration of fines, such as sediment and sand, can enter a production string during production of oil or gas. Examples of sand control techniques include, but are not limited to, using slotted liners and/or screens and gravel packing. A slotted liner can be a perforated pipe, such as a blank pipe. A screen usually contains holes that are smaller than the perforations in the slotted liner. The liner and/or screen can cause bridging of the fines against the liner or screen as oil or gas is being produced.

Gravel can be of varying sizes depending on the size of the formation sand to be excluded. Gravel typically has a largest dimension ranging from 0.2 millimeters (mm) up to 2.4 mm. However, other gravel sizes are possible. Gravel is commonly part of a slurry in which a carrier liquid makes up the continuous phase of the slurry and the gravel comprises the dispersed phase of the slurry. In gravel packing operations, the slurry is pumped into an open-hole or cased-hole portion of a wellbore. In order to isolate the portion of the wellbore to be gravel packed, a first packer can be placed at a location above the zone of interest and a second packer can be placed at a location below the zone of interest. In this manner, the gravel slurry can be placed in the zone of interest. Gravel packing requires very large volumes of a carrier fluid to deliver the gravel to the portion of the wellbore to be gravel-packed. For a cased-hole portion, the gravel slurry can be placed in the annulus between the wall of the wellbore and the outside of the casing, in the annulus between the inside of the casing and the outside of the tubing, screen string, or both. For an open-hole portion, the gravel slurry can be placed in the annulus between the wall of the wellbore and the outside of the tubing and/or screen.

At least two tubing strings are required for gravel packing. The gravel slurry is pumped into the zone of interest using one string; and at least some of the liquid continuous phase can flow into the screen and into a second string where the liquid is returned to surface. The gravel can remain in the zone of interest. The remaining gravel functions to maintain the stability of an open-hole wellbore portion by helping to prevent the wall of the wellbore from sloughing or caving into the annular space between the wall of the wellbore and the screen. Moreover, once placed in the zone of interest, the gravel can also help to control reservoir solids from entering the production equipment or plugging the porous portions of the liner or screen.

Another common stimulation technique is called hydraulic fracturing. A treatment fluid adapted for this purpose is sometimes referred to as a fracturing fluid. The fracturing fluid is pumped at a sufficiently high flow rate and high pressure into the wellbore and into the subterranean formation to create or enhance a fracture in the subterranean formation. Creating a fracture means either, making a new fracture in the formation or enhancing, enlarging, or extending a pre-existing fracture in the formation. Packers are commonly used with fracturing techniques, thus enabling fracturing in a desired zone of the wellbore. To fracture a subterranean formation typically requires hundreds of thousands of gallons of fracturing fluid. Furthermore, the fracturing fluid may be pumped down into the wellbore at high rates and pressures, for example, at a flow rate in excess of 100 barrels per minute (4,200 U.S. gallons per minute) at a pressure in excess of 10,000 pounds per square inch ("psi").

A newly-created or extended fracture will tend to close together after the pumping of the fracturing fluid is stopped. To prevent the fracture from closing completely, a material must be placed in the fracture to keep the fracture propped open. A material used for this purpose is often referred to as a "proppant." The proppant is in the form of a solid particulate, which can be suspended in the fracturing slurry, carried downhole, and deposited in the fracture as a "proppant pack." The proppant pack props the fracture in an open condition while allowing fluid flow through the permeability of the pack. The size of proppant is generally classified wherein at least 90% of the proppant has one size in the range from 0.2 mm to 2.4 mm. However, other sizes can also be used. As with gravel packing, at least two tubing strings are required to fracture the formation, deposit the proppant, and return the carrier fluid minus the proppant to the surface.

Wellbore operations can also be performed in a lateral wellbore. A lateral wellbore is a wellbore extending into a subterranean formation from a primary wellbore. A lateral wellbore can be created in a vertical, inclined, or horizontal portion of the primary wellbore or in multiple locations of combinations thereof. In order to form a lateral wellbore, a junction is created. The junction is the location where the lateral wellbore branches off from the primary wellbore. The junction is generally sealed above and below the junction in the primary wellbore and below the junction in the lateral wellbore. In general, where multiple tubing strings are used in a single wellbore, conventional circular cross-section tubing strings have merely been positioned side-by-side in the wellbore. Although this may be the easiest solution, it is also very inefficient in utilizing the available cross-sectional area in the wellbore. A sealed junction can significantly limit the flow of fluids through the sealed area when multiple tubing strings are required. Therefore, wellbore operations that require high volumes of fluid and flow rates are generally performed before sealing a junction.

However, there is a need to be able to perform wellbore operations that require large volumes of fluids and high flow rates using multiple tubing strings after creating a sealed junction of a wellbore. It has been discovered that a multi-tube system can be used to perform wellbore operations requiring large volumes of fluid and high flow rates in a wellbore that has a sealed junction.

According to an embodiment, a method of completing a portion of a wellbore comprises: (A) introducing a treatment fluid comprising a base fluid and a gravel from a wellhead into an upper portion of the wellbore; (B) flowing the treatment fluid through a first tube or first set of tubes of a multi-tube system from the upper portion of the wellbore to a sealed junction formed between the upper portion of the wellbore, a lower portion of the wellbore, and at least one lateral wellbore; (C) depositing at least a portion of the gravel within the lower portion of the wellbore or the lateral wellbore; and (D) returning at least a portion of the base fluid through a second tube or second set of tubes of the multi-tube system from the lower portion of the wellbore or the lateral wellbore to the wellhead, wherein the multi-tube system comprises multiple tubular members rigidly attached to each other along the axial lengths of the members, and wherein the attached tubular members complimentarily create a cross-sectional shape of a generally D-shaped portion of a circle.

According to another embodiment, a method of stimulating a portion of a subterranean formation comprises: (A) introducing a treatment fluid comprising a base fluid and proppant from a wellhead into an upper portion of the wellbore, wherein the wellbore penetrates the subterranean formation; (B) flowing the treatment fluid through a first tube or first set of tubes of a multi-tube system from the upper portion of the wellbore to a sealed junction formed between the upper portion of the wellbore, a lower portion of the wellbore, and at least one lateral wellbore; (C) creating one or more fractures in the subterranean formation during the step of introducing; (D) depositing at least a portion of the proppant within the one or more fractures; and (E) returning at least a portion of the base fluid through a second tube or second set of tubes of the multi-tube system from the junction to the wellhead, wherein the multi-tube system comprises multiple tubular members rigidly attached to each other along the axial lengths of the members, and wherein the attached tubular members complimentarily create a cross-sectional shape of a generally D-shaped portion of a circle.

Any discussion of a particular component of the well system (e.g., a conduit) is meant to include the singular form of the component and also the plural form of the component, without the need to continually refer to the component in both the singular and plural form throughout. For example, if a discussion involves "the conduit," it is to be understood that the discussion pertains to one conduit (singular) and two or more conduits (plural). It is also to be understood that any discussion of a particular component or particular embodiment regarding a component is meant to apply to all of the method embodiments without the need to re-state all of the particulars for each of the method embodiments.

Figure 2:
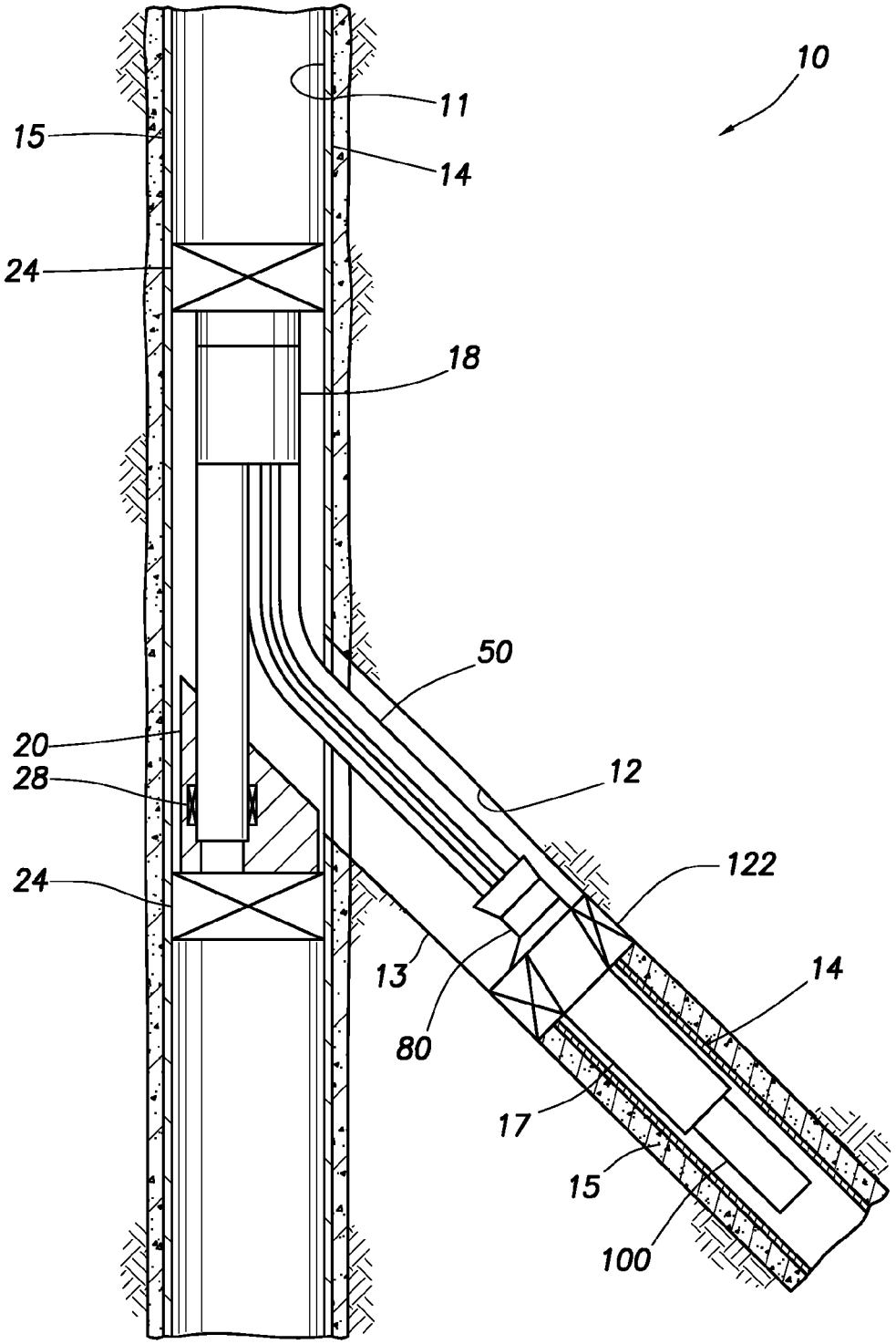
FIG. 2 is a cross-sectional view of a well system including cased and cemented lateral wellbore and multi-tube system according to certain embodiments.

Turning to the Figures, FIG. 1 is a diagram of a well system 10. The well system includes a main wellbore 11. The main wellbore 11 can penetrate a subterranean formation and extend into the ground from a wellhead (not shown). Portions of the main wellbore 11 can include a casing 14. The casing 14 can be cemented in place using a cement 15. At least one lateral wellbore 12 can extend off of the main wellbore 11. The well system 10 can also include more than one lateral wellbore off of the main wellbore. There can also be one or more tertiary lateral wellbores that extend off of a secondary lateral wellbore that extends off of the main or primary wellbore. As can be seen in FIG. 1, the lateral wellbore 12 can be open hole and include a wall of the lateral wellbore 13 that is uncased and uncemented. By contrast, as can be seen in FIG. 2, portions of the lateral wellbore 12 can include casing 14 and cement 15.

The junction formed between the upper portion of the wellbore, a lower portion of the wellbore, and at least one lateral wellbore 12 (i.e., the location where the lateral wellbore branches off from the main wellbore or the tertiary lateral wellbore branches off from a secondary lateral wellbore) can be a TAML level 1, 2, 3, 4, 5, or 6. The exact TAML level can depend on the specific wellbore and subterranean formation conditions that are present for a given wellbore operation. Multi-lateral well classifications were established by the Technology Advancement for Multilaterals (TAML) association. As used herein, the following descriptions are used for the TAML levels: Level 1—the main wellbore 11 and lateral wellbore 12 are open hole at the junction; Level 2—the main wellbore 11 is cased and cemented, but the lateral wellbore 12 is open hole at the junction; Level 3—the main wellbore 11 is cased and cemented, and the lateral wellbore 12 is mechanically tied back to the main wellbore casing (e.g., with a liner), but not cemented; Level 4—both the main wellbore 11 and the lateral wellbore 12 are cased and cemented, wherein the cement provides zonal isolation but not a hydraulic seal at the location of the junction; Level 5—pressure integrity is achieved at the junction through the use of the completion equipment instead of cement; and Level 6—pressure integrity is achieved at the junction through the use of casing instead of the completion equipment or cement. The junction is a sealed junction. As used herein, the phrase "sealed junction" means that fluid flow is prevented or substantially inhibited from flowing past or around the junction in any annular space therein. The junction can be sealed with the use of packers 24 in the main wellbore 11. The lateral wellbore 12 can also contain packers 122. The packers 24 and the top packer 122 can seal the junction to prevent fluid flow above or below the packers. As used herein, the relative term "top" means at a location closer to the wellhead for the main wellbore 11 or closer to the junction for the lateral wellbore 12.

The well system 10 includes two tubing strings, either or both strings having D-shaped cross-sections positioned side-by-side in the main wellbore 11. At least one of the strings includes a multi-tube system 50. The tubing strings 16, 50 are run into the main wellbore 11 and secured to each other at an upper end by a Y-connector 18.

A deflector 20 (such as a whipstock) is positioned in the main wellbore 11 and deflects the tubing string having the multi-tube system 50 from the main wellbore 11 into the lateral wellbore 12 as the tubing strings are conveyed into the well. The deflector 20 is positioned in the main wellbore 11 and can be secured with a bottom packer 24 or other anchoring device. The tubing string 16 is not deflected into the lateral wellbore 12, but instead is directed into the deflector 20. Seals 28 in the deflector 20 sealingly engage the tubing string 16. A top packer 24 can anchor the tubing strings 16, 50 in the main wellbore 11. The top packer 24 can secure the tubing strings 16, 50 in position and permits commingled flow via the tubing strings to the main wellbore 11 above the top packer 24. Of course, the tubing strings can also remain separated to the top of the wellbore rather than allowing comingled fluid flow above the top packer.

A cross-over tool 80 can be used to adapt the D-shaped tubing string 50 to the generally cylindrical shape of a lateral tubing string 17 attached to the cross-over tool 80. A tool 100 can be attached to the lateral tubing string 17.

The methods include introducing a treatment fluid into the wellbore. The treatment fluid can be introduced into the main wellbore 11 and the lateral wellbore 12. The wellbore penetrates the subterranean formation.

The treatment fluid includes a base fluid. As used herein, the term "base fluid" means the fluid that is in the greatest quantity and is either the solvent of a solution or the continuous phase of a heterogeneous fluid. The treatment fluid can be a slurry in which the base fluid is the continuous phase and the gravel or proppant is part of the dispersed phase. It should be understood that any of the phases of the treatment fluid can include dissolved or undissolved substances. The treatment fluid can also include other ingredients other than the base fluid and gravel or proppant that is common to include in such a fluid. For example, the fluid can also include a suspending agent or viscosifier for suspending the gravel or proppant in the base fluid. There are a variety of additives that are commonly included in gravel pack and fracturing fluids, and one of ordinary skill in the art will be able to select the exact ingredients and concentrations thereof to design the most appropriate fluid for the specific operation.

The base fluid can be an aqueous liquid, an aqueous miscible liquid, or a hydrocarbon liquid. Suitable aqueous-based fluids can include, but are not limited to, fresh water; saltwater (e.g., water containing one or more water-soluble salts dissolved therein); brine (e.g., saturated salt water); seawater; and any combination thereof. Suitable aqueous-miscible fluids can include, but are not limited to, alcohols (e.g., methanol, ethanol, n-propanol, isopropanol, n-butanol, sec-butanol, isobutanol, and t-butanol); glycerins; glycols (e.g., polyglycols, propylene glycol, and ethylene glycol); polyglycol amines; polyols; any derivative thereof; any in combination with salts (e.g., sodium chloride, calcium chloride, magnesium chloride, potassium chloride, sodium bromide, calcium bromide, zinc bromide, potassium carbonate, sodium formate, potassium formate, cesium formate, sodium acetate, potassium acetate, calcium acetate, ammonium acetate, ammonium chloride, ammonium bromide, sodium nitrate, potassium nitrate, ammonium nitrate, ammonium sulfate, calcium nitrate, sodium carbonate, and potassium carbonate); any in combination with an aqueous-based fluid; and any combination thereof.

The hydrocarbon liquid can be synthetic. The hydrocarbon liquid can be selected from the group consisting of: a fractional distillate of crude oil; a fatty derivative of an acid, an ester, an ether, an alcohol, an amine, an amide, or an imide; a saturated hydrocarbon; an unsaturated hydrocarbon; a branched hydrocarbon; a cyclic hydrocarbon; and any combination thereof. Crude oil can be separated into fractional distillates based on the boiling point of the fractions in the crude oil. An example of a suitable fractional distillate of crude oil is diesel oil. A commercially-available example of a fatty acid ester is PETROFREE® ESTER base fluid, marketed by Halliburton Energy Services, Inc. The saturated hydrocarbon can be an alkane or paraffin. The paraffin can be an isoalkane (isoparaffin), a linear alkane (paraffin), or a cyclic alkane (cycloparaffin). An example of an alkane is BAROID ALKANE™ base fluid, marketed by Halliburton Energy Services, Inc. Examples of suitable paraffins include, but are not limited to: BIO-BASE 360® an isoalkane and n-alkane; BIO-BASE 300™ a linear alkane; BIO-BASE 560® a blend containing greater than 90% linear alkanes; and ESCAID 110™ a mineral oil blend of mainly alkanes and cyclic alkanes. The BIO-BASE liquids are available from Shrieve Chemical Products, Inc. in The Woodlands, Tex. The ESCAID liquid is available from ExxonMobil in Houston, Tex. The unsaturated hydrocarbon can be an alkene, alkyne, or aromatic. The alkene can be an isoalkene, linear alkene, or cyclic alkene. The linear alkene can be a linear alpha olefin or an internal olefin. An example of a linear alpha olefin is NOVATEC™, available from M-I SWACO in Houston, Tex. Examples of internal olefins-based drilling fluids include ENCORE® drilling fluid and ACCOLADE® internal olefin and ester blend drilling fluid, marketed by Halliburton Energy Services, Inc. An example of a diesel oil-based drilling fluid is INVERMUL®, marketed by Halliburton Energy Services, Inc.

According to certain embodiments, the treatment fluid is a gravel pack fluid and the treatment fluid includes the gravel. The gravel pack fluid can be used to gravel pack one or more portions of the main wellbore 11 or portions of one or more lateral wellbores 12. According to certain other embodiments, the treatment fluid is a hydraulic fracturing fluid and the treatment fluid includes proppant. The fracturing fluid can be used to create one or more fractures in the subterranean formation. The proppant can be used to prop the fractures open and pack the fractures.

Figure 3:
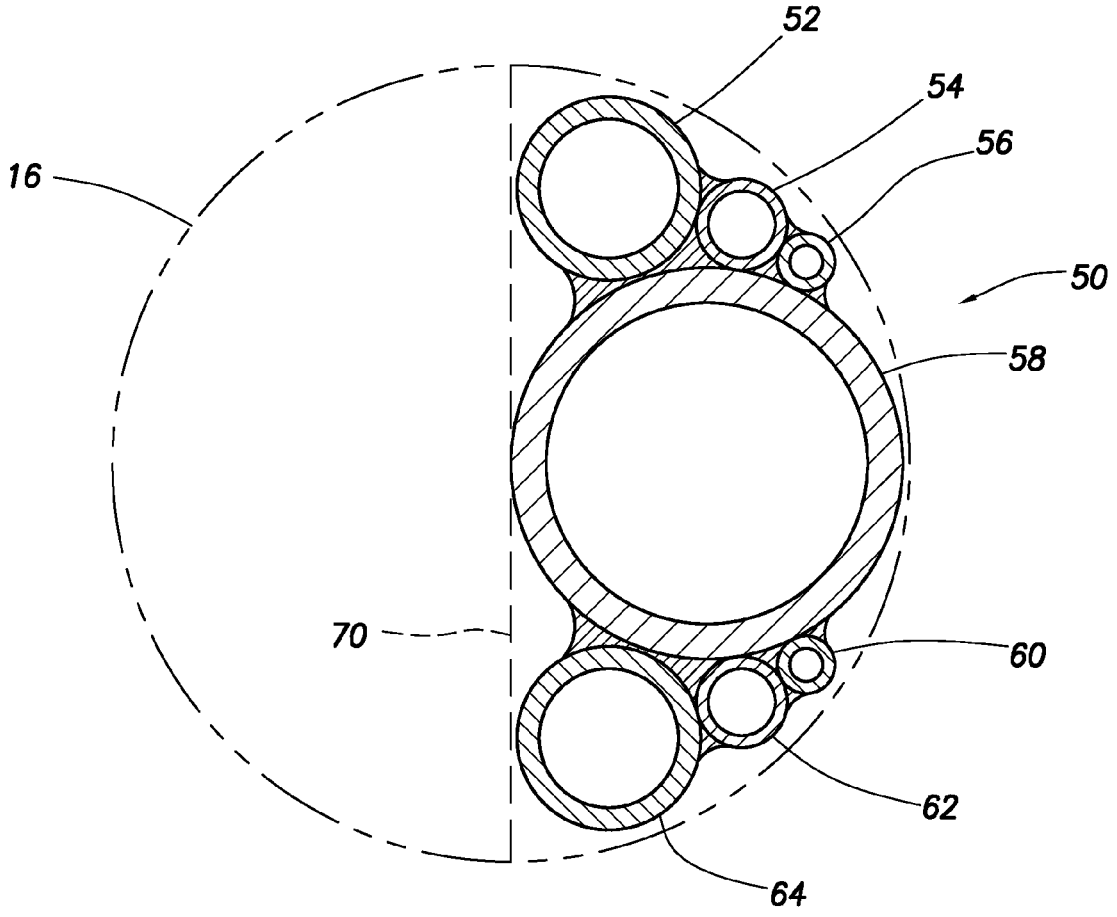
FIG. 3 is an enlarged scale cross-sectional view through the tubing string and multi-tube system, taken along line 3-3 of FIGS. 1 and 2.

Referring now to FIG. 3, an enlarged cross-section taken along line 3-3 of FIG. 1 is illustrated. In this view, the D-shaped cross-sections of the tubing strings 16, 50 may be clearly seen. Each of the tubing strings 16, 50 are made up of a flat inner side and a curved outer side. Each inner side is welded along its longitudinal edges to one of the outer sides. Although only one multi-tube system 50 is shown in FIG. 3 for clarity of illustration, it will be readily appreciated that another multi-tube system 50 may be positioned on an opposite side of a dashed line 70 separating the main wellbore 11 into two D-shaped circular portions. Alternatively, the tubing string could be wedge-shaped, so that three or more of the multi-tube systems 50 could be positioned in the main wellbore 11. This embodiment could provide one or more of the multi-tube systems 50 to be positioned within two or more lateral wellbores and/or main wellbore.

As can be seen in FIG. 3, the multi-tube system 50 is made up of tubular members 52, 54, 56, 58, 60, 62, 64. Of course, any number of tubes may be used in the multi-tube system 50. The tubes 52, 54, 56, 58, 60, 62, 64 may also be positioned differently from that shown in FIG. 3.

The tubes 52, 54, 56, 58, 60, 62, 64 are rigidly attached to each other along the axial lengths of the members, along their entire, or substantially entire, axial lengths. As depicted in FIG. 3, the tubes 52, 54, 56, 58, 60, 62, 64 are attached to each other by welding, but other attaching means, such as adhesives, etc., may also be used. The tubes 52, 54, 56, 58, 60, 62, 64 may be attached to each other by spot welding, by continuous welding, or using any other fastening means.

The treatment fluid flows through a first tube or set of tubes of the multi-tube system 50 during the step of introducing or flowing. The treatment fluid also flows through a second tube or set of tubes of the multi-tube system 50 during the step of returning. According to certain embodiments, if the fluid flows through the first tube, then the fluid is returned via the second set of tubes; and if the fluid is returned via the second tube, then the fluid is introduced via the first set of tubes. These embodiments are due to the fact that the multi-tube system is made up of more than two tubes. As such the fluid cannot be introduced and returned via just one tube as that would mean the system only is made up of a total of two tubes instead of a multitude of tubes.

According to certain embodiments, the inner diameter (I.D.) of the first tube or the sum of the I.D.s of the first set of tubes is approximately equal to the I.D. of the second tube or the sum of the I.D.s of the second set of tubes. In this manner, the fluid will generally be less capable of becoming choked during the steps of introducing and returning. By way of example and as can be seen in FIG. 3, there can be a centrally located tube 58, which has a larger I.D. than any of the other tubes 52, 54, 56, 60, 62, 64. Tube 58 may be used as the first tube in which the treatment fluid carrying the gravel or proppant can have a large flow area, thus inhibiting or preventing bridging of the gravel or proppant during introduction into the wellbore. Thus, the tube 58 may serve as a main fluid conduit into the wellbore. According to this example, tubes 52, 54, 56, 60, 62, and 64 can be the second set of tubes used for return flow of the base fluid to the wellhead. Furthermore, the sum of the I.D. of tubes 52, 54, 56, 60, 62, and 64 can be approximately equal to (i.e., within about +/−25%) the I.D. of tube 58. Of course, the tubes 52, 54, 56, 60, 62, and 64 could be used to introduce the treatment fluid into the wellbore and the tube 58 could be used to return the fluid. Additionally, other configurations not reflected in the drawings can be used. For example, the multi-tube system 50 can include a total of 4 tubes, wherein the tubes have approximately the same I.D. Two of the tubes can be the first set of tubes and the other two tubes can be the second set of tubes.

The attached tubular members complimentarily create a cross-sectional shape of a generally D-shaped portion of a circle as shown in FIG. 3. Because only half of the longitudinal part of the tubing string is positioned within the main wellbore 11 and the other half in the lateral wellbore 12, the flow area for each half of the tubing string is reduced compared to an entire tubing string. The number of tubes can be selected and each tube's I.D. can be selected such that the majority of the area of the D-shaped portion of the circle is utilized as a flow area for the treatment fluid (both introduction and return flow). In this manner, the tubes are capable of handling the large amount of fluid and high flow rates required for gravel-packing and fracturing/packing operations without choking or causing bridging of the gravel or proppant.

Figure 4:
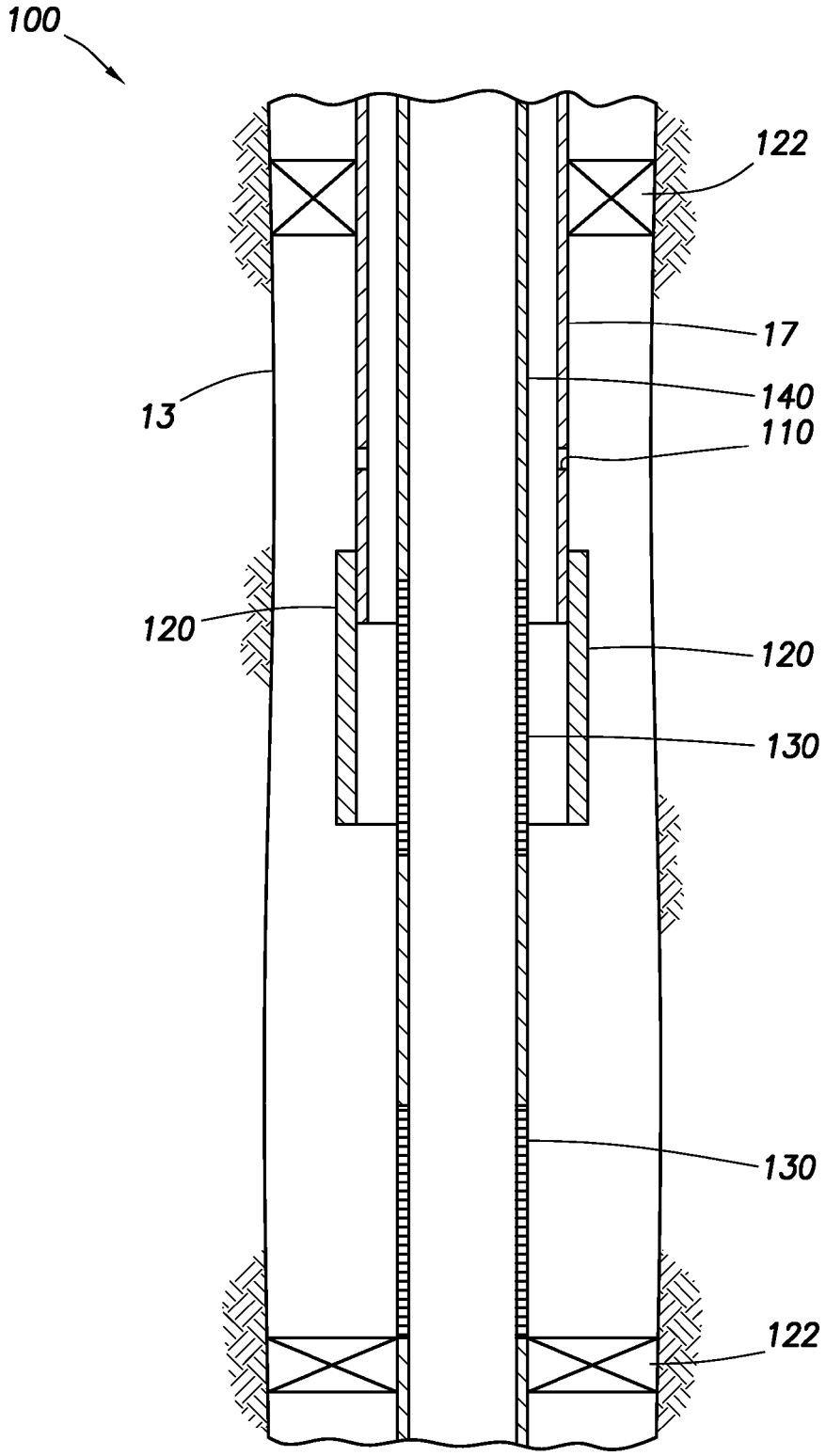
FIG. 4 is an enlarged scale cross-sectional view of the dashed lines of FIG. 1 showing a gravel packing tool with sand screen assembly.

Turning now to FIG. 4, which shows an enlarged view of the lateral tubing string 17 and tool 100 from FIG. 1. It is to be understood that the discussion related to FIG. 4 can apply equally to the lateral wellbore 12 as depicted in FIG. 2. For example, a gravel packing operation can be performed in an open-hole lateral wellbore as depicted in FIG. 1, and a fracturing operation can be performed in a cased and cemented lateral wellbore as depicted in FIG. 2. However, gravel packing operations can also be performed in cased wellbores and fracturing can be performed in open-hole wellbores.

The portion of the lateral wellbore 12 to be treated with the treatment fluid can be isolated via the packers 122. The tool 100 can be attached to either of the two tubing strings, such as the lateral tubing string 17. The tool 100 can be for gravel packing (as shown in FIG. 4) or for fracturing (not shown in the drawings). The tool 100 can include one or more sand screen assemblies 130 for filtering out fines or sand during production of a reservoir fluid. The following discussion relates to a gravel packing operation; however, one of ordinary skill in the art will be able to apply the discussion to hydraulic fracturing applications as well. Furthermore, the operation that is performed can also be performed within a portion of the main wellbore instead of the lateral wellbore. Also, there can be multiple operations performed within multiple wellbores.

Figure 5:
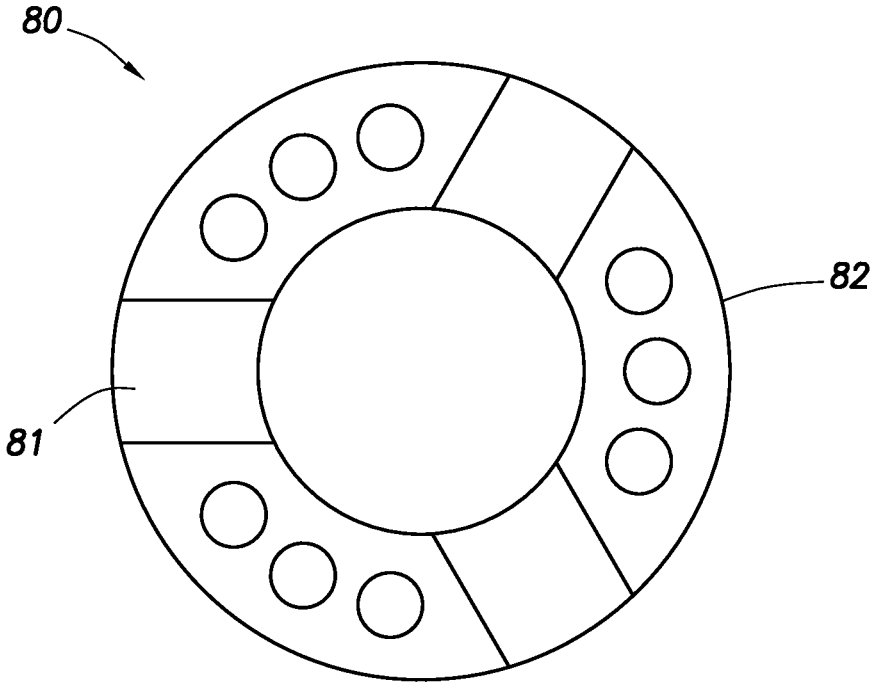
FIG. 5 is cross-sectional view of cross-over tool.

The treatment fluid can be introduced through the first tube or set of tubes of the multi-tube system 50 into the wellbore. The fluid can flow into the cross-over tool 80 shown in detail in FIG. 5. The fluid can flow for example through the first ports 81 of the cross-over tool 80 and then into the lateral tubing string 17. The lateral tubing string 17 can include ports 110. The treatment fluid can flow through ports 110 and optionally into perforated or permeable conduits 120 of the tool 100. The conduits can be used to help place the gravel and prevent bridging of the gravel. The treatment fluid can then flow into an annulus located between the outside of the tool 100 (for example, the sand screen assemblies) and the wall of the lateral wellbore 13 or the inside of the casing 14 of the lateral wellbore 12. The gravel, for example, of the treatment fluid can be deposited within at least a portion of the annulus. At least a portion of, a majority of, or all of, the base fluid then flows through the sand screen assemblies 130 and into the tubing string 140, such as a production tubing string. The sand screen assemblies 130 can help prevent return of the gravel or proppant. The base fluid can then flow up the tubing string 140, through the second ports 82 of the cross-over tool 80, and into the second tube or set of tubes and back to the wellhead. The second ports 82 can be perforated to also prevent or inhibit return of the gravel or proppant or other insoluble formation particles.

For fracturing operations, the tool 100 can include one or more sliding sleeves (not shown). The methods include creating one or more fractures in the subterranean formation during the step of introducing. The proppant can then be deposited and packed into the fractures.

A combination of fracturing and gravel packing operations can also be performed. This is known to those skilled in the art as frac-packing. This method uses hydraulic pressure to fracture the formation, as previously described, and then gravel packing techniques, as previously described to prop the fractures open with gravel and fill the annulus between sand control assembly and formation to exclude sand production.

The steps of introducing can include pumping the treatment fluid into the wellbore using one or more pumps. The methods can further include producing a reservoir fluid from the subterranean formation after the step of returning.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of stimulating a portion of a subterranean formation comprising:

(A) introducing a treatment fluid comprising a base fluid and proppant from a wellhead into an upper portion of the wellbore, wherein the wellbore penetrates the subterranean formation;

(B) flowing the treatment fluid through a first tube or first set of tubes of a multi-tube system from the upper portion of the wellbore to a sealed junction formed between the upper portion of the wellbore, a lower portion of the wellbore, and at least one lateral wellbore;

(C) creating one or more fractures in the subterranean formation during the step of introducing;

(D) depositing at least a portion of the proppant within the one or more fractures; and (E) returning at least a portion of the base fluid through a second tube or second set of tubes of the multi-tube system from the junction to the wellhead, wherein the multi-tube system comprises multiple tubular members rigidly attached to each other along the axial lengths of the members, and wherein the attached tubular members complimentarily create a cross-sectional shape of a generally D-shaped portion of a circle;

further comprising at least two tubing strings, each string having D-shaped cross-sections, are positioned side-by-side in the wellbore, wherein a cross-over tool is attached to one of the two tubing strings, wherein a tool is attached to the one of the two tubing strings below the cross-over tool, and wherein the tool is a hydraulic fracturing assembly.

2. The method according to claim 1, wherein at least one of the strings includes the multi-tube system.

3. The method according to claim 2, wherein the lateral wellbore comprises a lateral tubing string.

4. The method according to claim 3, wherein the cross-over tool is adapts the D-shaped tubing string containing the multi-tube system to a generally cylindrical shape of the one of the two tubing strings.

5. The method according to claim 1, wherein the tool further comprises one or more sand screen assemblies.

6. The method according to claim 1, wherein the treatment fluid is a slurry having a continuous phase and at least one dispersed phase, wherein the base fluid is the continuous phase and the proppant is part of the dispersed phase.

7. The method according to claim 1, wherein the base fluid is an aqueous liquid, an aqueous miscible liquid, a hydrocarbon liquid, or combinations thereof.

8. The method according to claim 1, wherein if the fluid flows through the first tube, then the fluid is returned via the second set of tubes; and if the fluid is returned via the second tube, then the fluid is introduced via the first set of tubes.

9. The method according to claim 1, wherein the inner diameter of the first tube or the sum of the inner diameters of the first set of tubes is approximately equal to the inner diameter of the second tube or the sum of the inner diameters of the second set of tubes.

10. The method according to claim 9, wherein the multi-tube system comprises a first tube that is centrally located within the D-shaped portion of the circle and has a larger inner diameter than any of the tubes of the second set of tubes.

11. The method according to claim 10, wherein the treatment fluid is introduced via the first tube, and wherein the proppant is inhibited or prevented from bridging upon each other during introduction due to the larger inner diameter of the first tube, and wherein the portion of the base fluid is returned via the second set of tubes.

12. The method according to claim 1, wherein the number of tubes of the multi-tube system is selected, and each tube's inner diameters are selected, such that the majority of the area of the D-shaped portion of the circle creates a flow area for the treatment fluid.

13. A method of stimulating a portion of a subterranean formation comprising:

(A) introducing a treatment fluid comprising a base fluid and proppant from a wellhead into an upper portion of the wellbore, wherein the wellbore penetrates the subterranean formation;

(B) flowing the treatment fluid through a first tube or first set of tubes of a multi-tube system from the upper portion of the wellbore to a sealed junction formed between the upper portion of the wellbore, a lower portion of the wellbore, and at least one lateral wellbore;

(C) creating one or more fractures in the subterranean formation during the step of introducing;

(D) depositing at least a portion of the proppant within the one or more fractures; and (E) returning at least a portion of the base fluid through a second tube or second set of tubes of the multi-tube system from the junction to the wellhead, wherein the multi-tube system comprises multiple tubular members rigidly attached to each other along the axial lengths of the members, wherein the attached tubular members complimentarily create a cross-sectional shape of a generally D-shaped portion of a circle, further comprising at least two tubing strings, each string having D-shaped cross-sections, are positioned side-by-side in the wellbore, wherein a cross-over tool is attached to one of the two tubing strings, wherein a tool is attached to the one of the two tubing strings below the cross-over tool, and wherein the tool is a hydraulic fracturing assembly, wherein the inner diameter of the first tube or the sum of the inner diameters of the first set of tubes is approximately equal to the inner diameter of the second tube or the sum of the inner diameters of the second set of tubes.

* * * * *